US006925997B2

(12) United States Patent
Sheng

(10) Patent No.: US 6,925,997 B2
(45) Date of Patent: Aug. 9, 2005

(54) PAINTGUN WITH PNEUMATIC FEEDING AND DISCHARGING PROCESS

(76) Inventor: Chih-Sheng Sheng, No. 100, Tzu Chiang W. Road, Kweishan Hsiang, TaoYuan Hsien (TW)

( * ) Notice: Subject to any disclaimer, the term of this patent is extended or adjusted under 35 U.S.C. 154(b) by 145 days.

(21) Appl. No.: 10/600,460

(22) Filed: Jun. 23, 2003

(65) Prior Publication Data

US 2005/0005924 A1 Jan. 13, 2005

(51) Int. Cl.[7] ..... F41B 11/00

(52) U.S. Cl. ..... 124/74; 124/73; 124/56; 124/66; 124/71; 124/76; 239/337; 239/329; 239/375

(58) Field of Search ..... 124/56, 66, 71, 124/76, 73–74

(56) References Cited

U.S. PATENT DOCUMENTS 2,631,891 A * 3/1953 Kochner et al.
2,721,763 A * 10/1955 Miner
3,612,026 A * 10/1971 Vadas et al. ..... 124/76
4,628,644 A * 12/1986 Somers
5,333,594 A * 8/1994 Robinson ..... 124/73
5,494,024 A * 2/1996 Scott ..... 124/73
5,497,758 A * 3/1996 Dobbins et al. ..... 124/73
5,778,868 A * 7/1998 Shepherd ..... 124/76
6,286,497 B1 * 9/2001 Levkov ..... 124/73
6,371,099 B1 * 4/2002 Lee ..... 124/66
6,405,722 B2 * 6/2002 Colby ..... 124/74
6,439,217 B1 * 8/2002 Shih ..... 124/74
6,532,949 B1 * 3/2003 McKendrick ..... 124/73
6,601,780 B1 * 8/2003 Sheng ..... 239/337
6,618,975 B1 * 9/2003 Shih ..... 124/73
6,644,295 B2 * 11/2003 Jones ..... 124/73

* cited by examiner

*Primary Examiner*—Michael J. Carone
*Assistant Examiner*—Lulit Semunegus
(74) *Attorney, Agent, or Firm*—Rosenberg, Klein & Lee

(57) ABSTRACT

The invention relates to a paintgun with pneumatic feeding and discharging process characterized by a pneumatic delivery mechanism. The pneumatic delivery mechanism comprises a flow-guiding body forming a major air channel at front end and a flow-guiding chamber at rear end thereof, a flow-guiding movable body utilizing a valve body to divide the flow-guiding chamber into a front and a rear air pressure chamber with different pressure area and a delivery tube placed around a tube at front part of the flow-guiding body. Moreover, a stopper controls the opening or closing of air flow channel, thereby changing the pressure difference between the front and the rear air pressure chambers. The delivery tube is shifted forward by a small amount of air flow fed into a minor air channel for pushing a paintball a little forward. Thereafter, the paintball is discharged by thrust of air flow into the major air channel.

11 Claims, 14 Drawing Sheets

PAINTGUN WITH PNEUMATIC FEEDING AND DISCHARGING PROCESS

BACK GROUND OF THE INVENTION

1. Field of the Invention

The invention relates to a paintgun with pneumatic feeding and discharging process, and more particularly, to a paintgun which controls the opening and closing of the airflow channel in such a way that the flow-field pressure is changed to complete two-stage feeding and discharging process.

2. Description of the Related Art

A plurality of conventional paintguns (e.g. TW 447697, 443486, 406894, 437941, etc.), as shown in FIGS. 1 and 2, have a trigger assembly 11 above which a barrel assembly 12 is disposed. The barrel assembly 12 consists of an ejector tube 121 and an air chamber tube 122 both of which are in parallel with each other. A bore 13 is installed at the front end of the ejector tube 121 while a feeding tube 14 is fixed at the top thereof. The feeding tube 14 is connected with a loader to supply paintballs B. The air chamber tube 122 is fitted with an air valve 161 and an air valve spring 162 at the front end and with a delivery mechanism 17 at the rear end thereof. A hollow connector 18 is arranged at the bottom near the front end so as to be in connection with a tank 15. A pull rod 19 is disposed within the barrel assembly 12 and the rear end thereof projects from the barrel assembly 12.

Moreover, the pull rod 19 has a firing pin 191 within the air chamber tube 122, and the firing hammer 191 is coupled with the pull rod 19 by means of an insertion bolt 193. The front end of the firing hammer 191 is closed and pressed against the air valve 161 while the rear end thereof accommodates a spring 171 of a delivery mechanism 17 for pushing against the firing hammer 191. The firing hammer 191 is provided with positioning groove 192 at the bottom thereof (see FIG. 3). The movement of the firing hammer 191 can be controlled by an engaging member 111 of the trigger assembly 11 together with the positioning groove 192, thereby reaching the firing effect. However, the contact surface of the engaging member 111 and the positioning groove 192 will be rubbed after discharge of the paintgun each time. Accordingly, the engaging effect of the engaging member 111 will be lowered gradually such that it's easy to cause a firing by mistake. The safety is much threatened. Moreover, the components of the conventional paintgun are numerous, and the connection thereof is complicated so that it's not easy for assembly and malfunction.

In addition, as shown in FIG. 1, the pull rod 19 has to be pulled backward in position in prior to discharge. During the discharge, it moves to and fro such that the rear member 194 projecting from the barrel easily injure the human body. It's much dangerous.

Furthermore, the bolt 193 is easiy broken off due to the side shear force when different axial action forces are exerted on the firing hammer 191 and the pull rod 19 during to-and-fro movement.

As shown in FIG. 2, when the trigger assembly 11 is pulled to bring the firing hammer 191 together with the pull rod 19 forwards, the air valve 161 is pushed open by the firing hammer 191, thereby releasing air pressure part of which flows into the air chamber tube 122 to return the firing hammer 191 in place and another part of which flows through a channel 123 and enters into the ejector tube 121 to discharge the paintball B. Accordingly, the air pressure used to discharge the paintball B has a curved and dispersed flow direction, thereby resulting in air turbulence. Therefore, the reduced air pressure can't bring the paintball B forward for discharge. Thus, the tank 15 has to be kept in a higher pressure. For example, most paintguns require a pressure at 50 kg/cm$^2$ for a smooth discharge of the paintball B to a prearranged distance. However, the higher the air pressure of the tank is, the more the cost thereof will be raised. Besides, the available air amount is also diminished and the danger is much elevated.

Consequently, the conventional paintgun leaves much to be improved.

SUMMARY OF THE INVENTION

It is a primary object of the invention to provide a paintgun with pneumatic feeding and discharging process in which the paintball discharge is pneumatically controlled to replace the conventional mechanical way by engaging the firing hammer. Thus, the use safety is much ensured and the malfunction thereof is considerably reduced.

It is another object of the invention to provide a paintgun with pneumatic feeding and discharging process which has advantages of simple configuration, easy assembly and low cost.

It is a further object of the invention to provide a paintgun with pneumatic feeding and discharging process in which a limited amount of airflow is used to push a push tube forward first such that the paintball is brought forward to change the pressure of the front and rear ends of the flow-guiding valve. Accordingly, a great amount of airflow is brought through a major air channel for discharging the paintball. Thus, the invention has advantages of smooth feeding of air flow. In addition, the paintball can be discharged by thrust of air flow even with smaller air pressure.

BRIEF DESCRIPTION OF THE DRAWINGS

The accomplishment of this and other objects of the invention will become apparent from the following descriptions and its accompanying drawings of which:

FIG. 5(*a*) is a perspective exploded view of the barrel assembly of the invention;

FIG. 5(*b*) is a perspective exploded view of the barrel assembly and the pneumatic delivery mechanism of the invention;

FIG. 11(*a*) is a sectional view of the invention with another applicable embodiment of the stopper;

FIG. 11(*b*) is an enlarged view of the circle area marked by dashed line in FIG. 11(*a*) wherein the remaining gas is exhausted from the connection channel via the returning hole to an exhaust hole at the bottom of the stopper;

FIG. 11(*c*) is an enlarged view of the circle area marked by dashed line in FIG. 11(*a*) wherein the stopper is moved downward to open the lower outlet;

DETAILED DESCRIPTION OF THE PREFERRED EMBODIMENT

Figure 1:
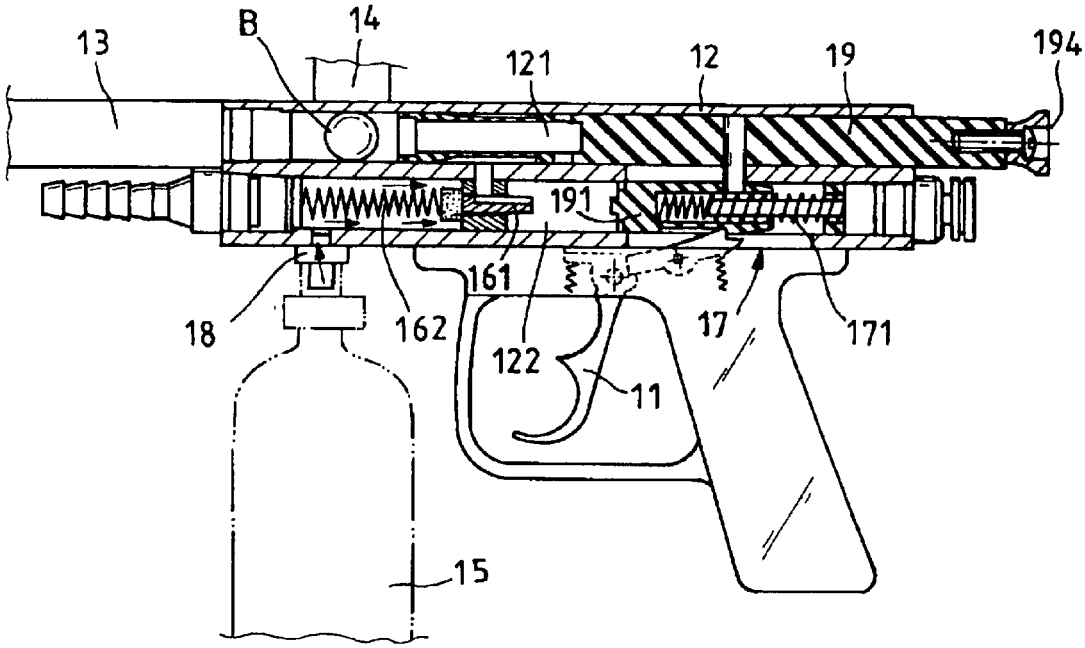
FIG.1 PRIOR ART
FIG. 1 is a sectional view of a conventional paintgun before pulling the trigger.
Figure 2:
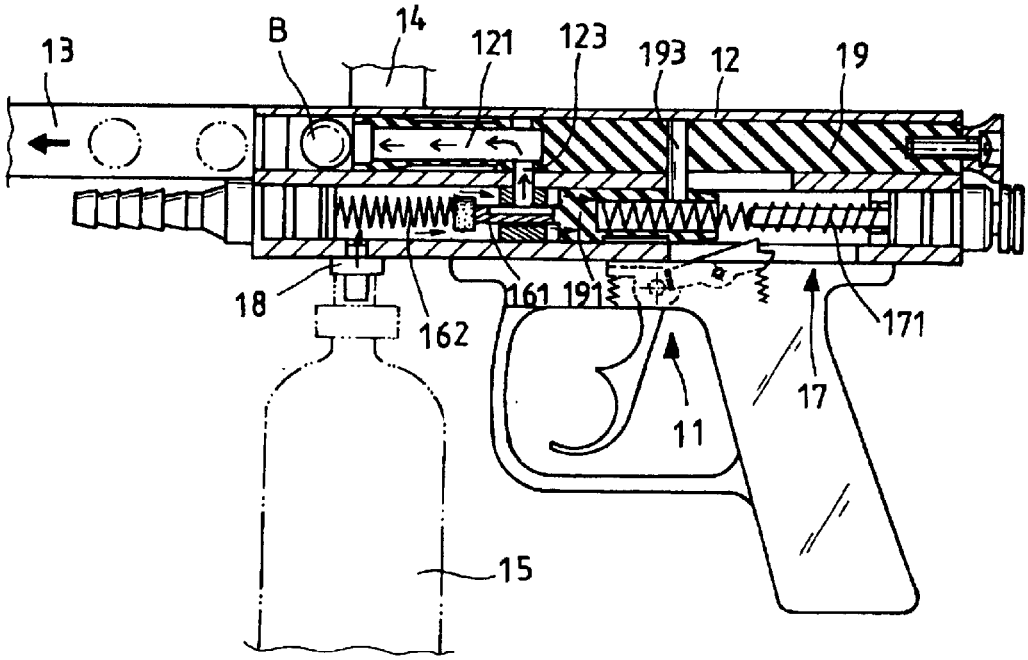
FIG.2 PRIOR ART
FIG. 2 is a sectional view of the conventional paintgun after pulling the trigger.
Figure 3:
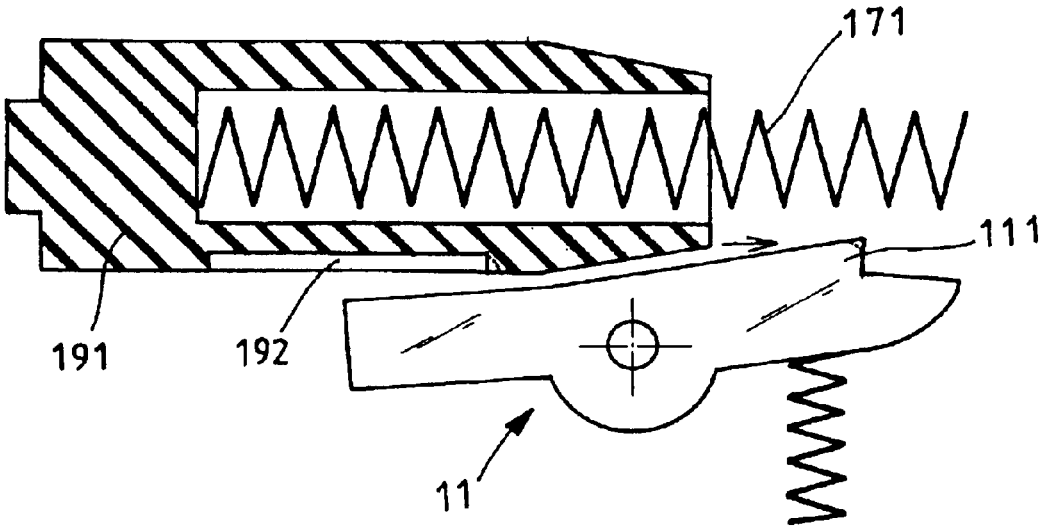
FIG. 3 PRIOR ART
FIG. 3 is a schematic drawing of the trigger and the firing hammer of the conventional paintgun after pulling the trigger.
Figure 4:
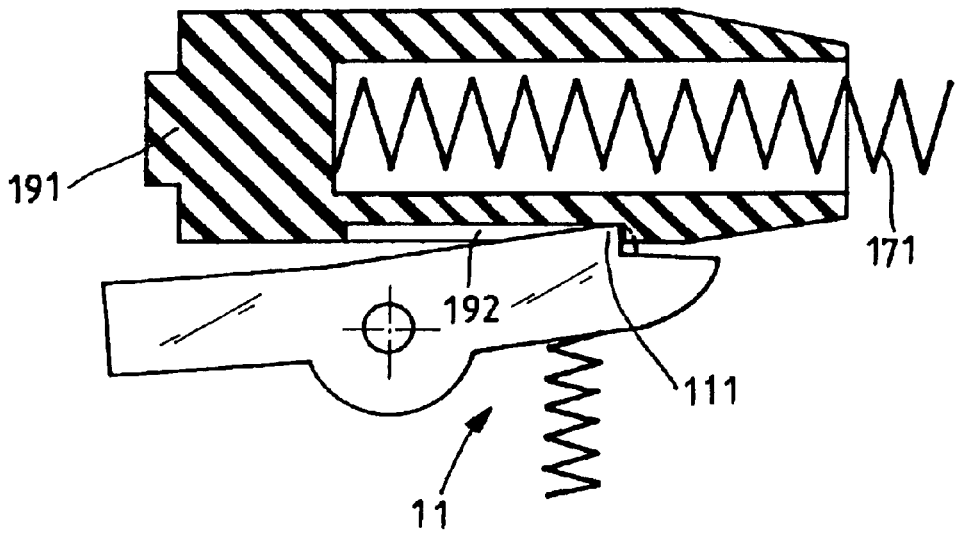
FIG. 4 PRIOR ART
FIG. 4 is a schematic drawing of the trigger and the firing hammer of the conventional paintgun before pulling the trigger.
Figure 5:
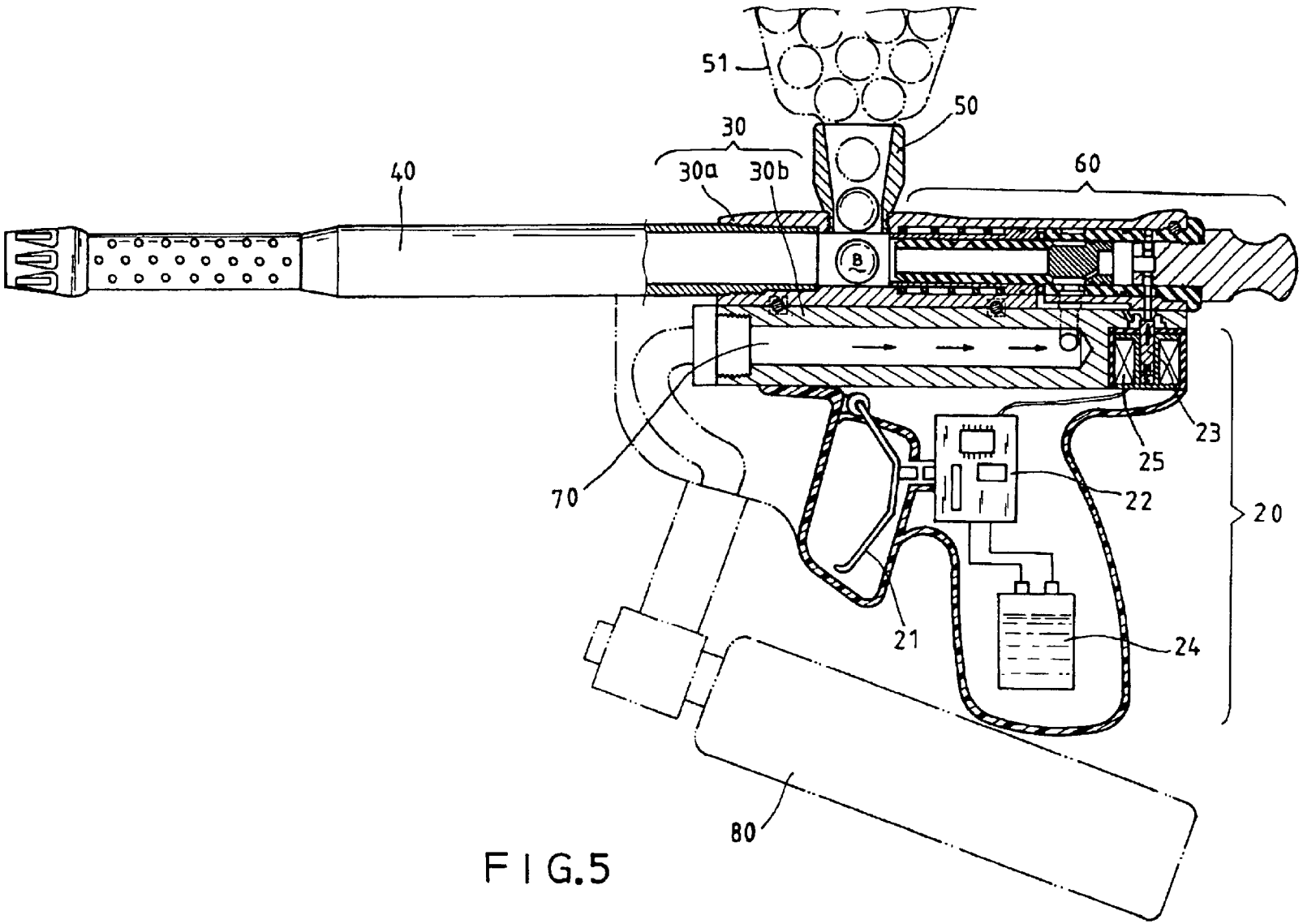
FIG. 5 is a sectional view of an applicable embodiment of the paintgun of the invention.
Figure 5A:
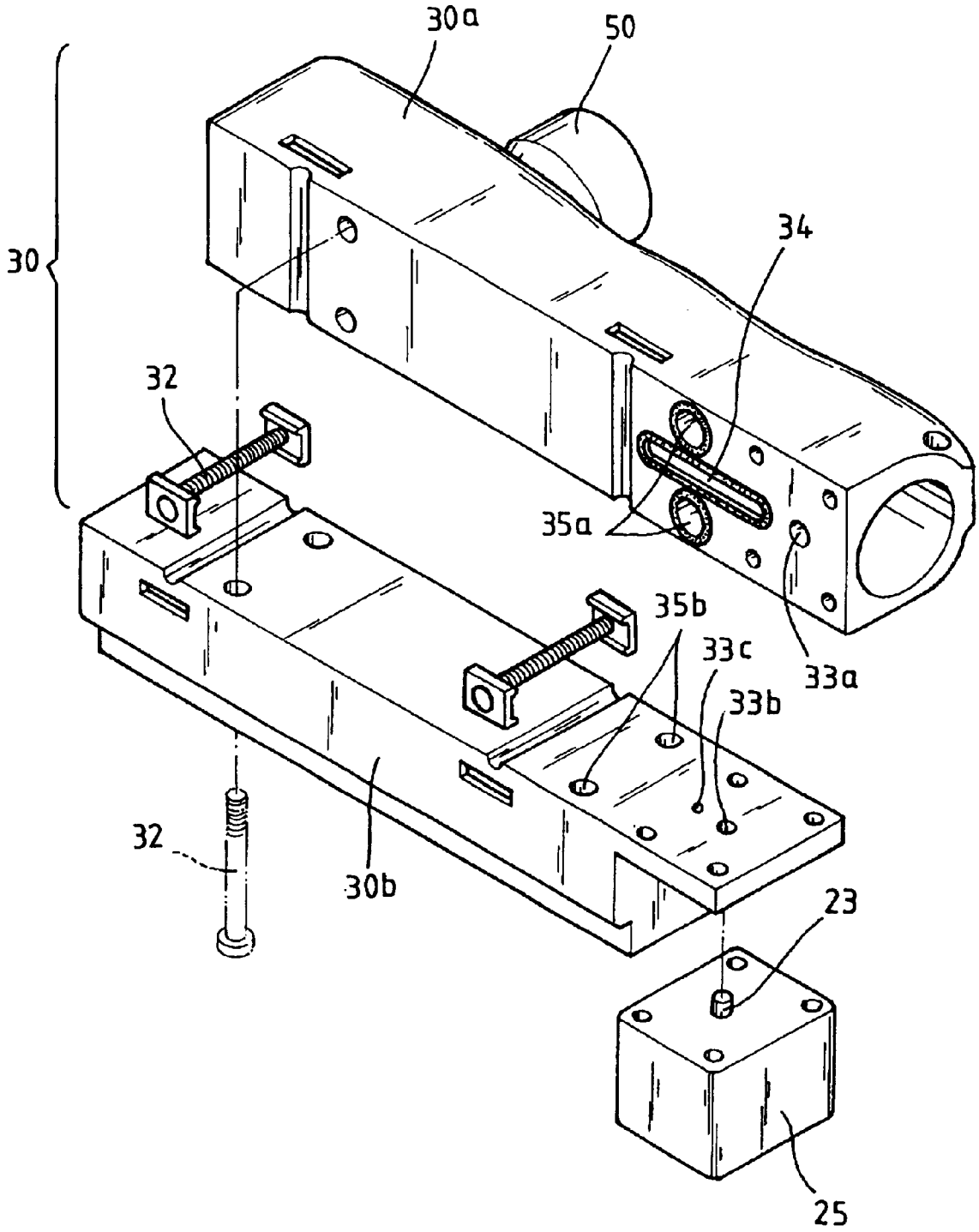
Figure 5B:
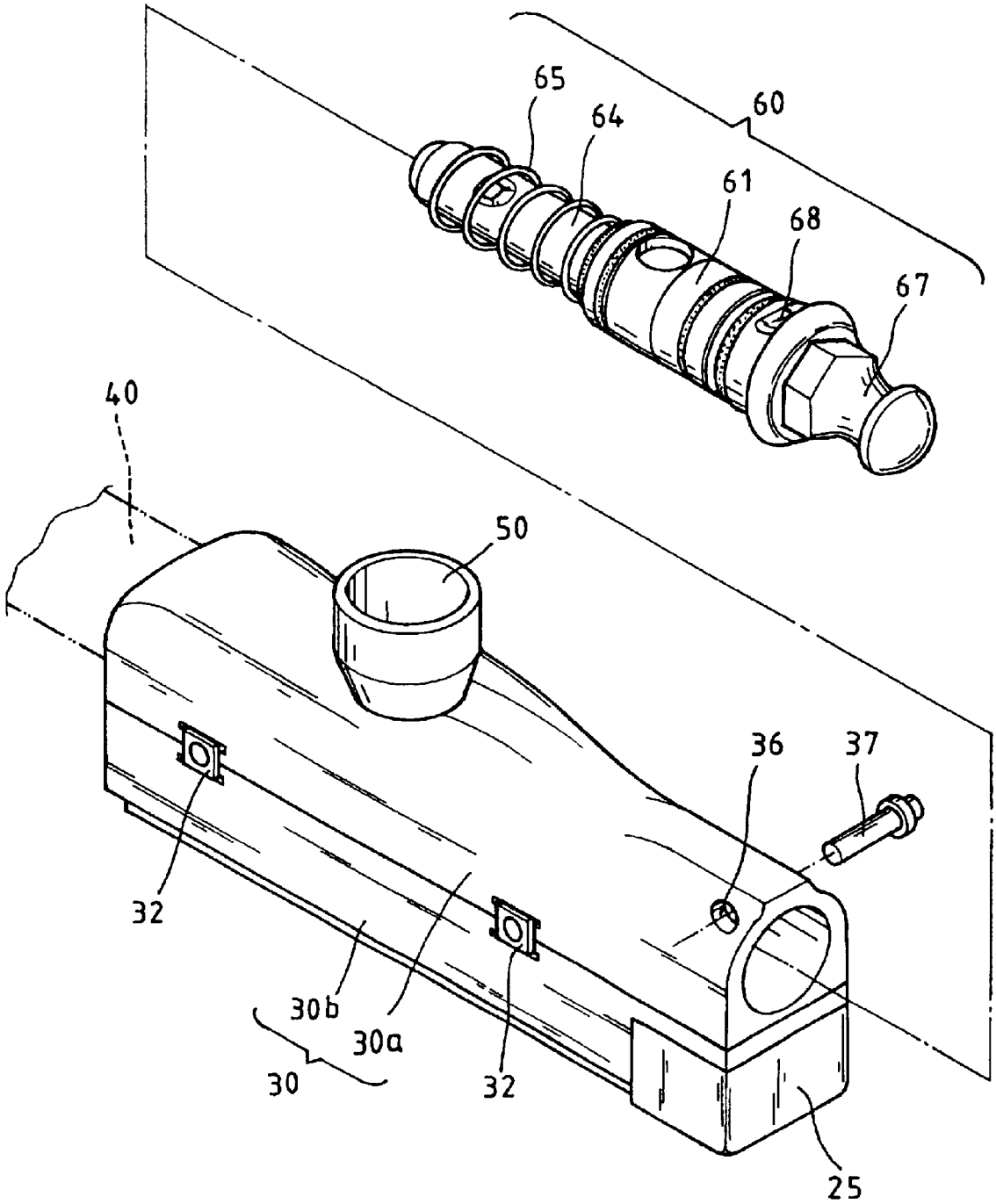

First of all, referring to FIG. 5, an improvement of the paintgun of the invention is shown. The paintgun in accordance with the invention mainly includes a trigger assembly 20, a barrel assembly 30 and a pneumatic delivery mechanism 60.

The trigger assembly 20 is used to actuate the firing element of paintballs B.

The barrel assembly 30 is fitted above the trigger assembly 20. Besides, the barrel assembly 30 can be formed in one piece or composed of an upper and a lower barrel 30*a*, 30*b*, as shown in FIG. 5(*a*), and both of which are assembled, as shown in FIG. 5(*b*), by fastening elements 32 such as screws or the like. Furthermore, the length of the lower barrel 30*b* is adjustable to different applications and not required to correspond to that of the upper barrel 30*a*. A bore 40 is provided at the front end thereof. Besides, a paintball-feeding tube 50 is disposed above the bore 40 for connecting with a tank 51 to supply paintballs B.

Figure 6:
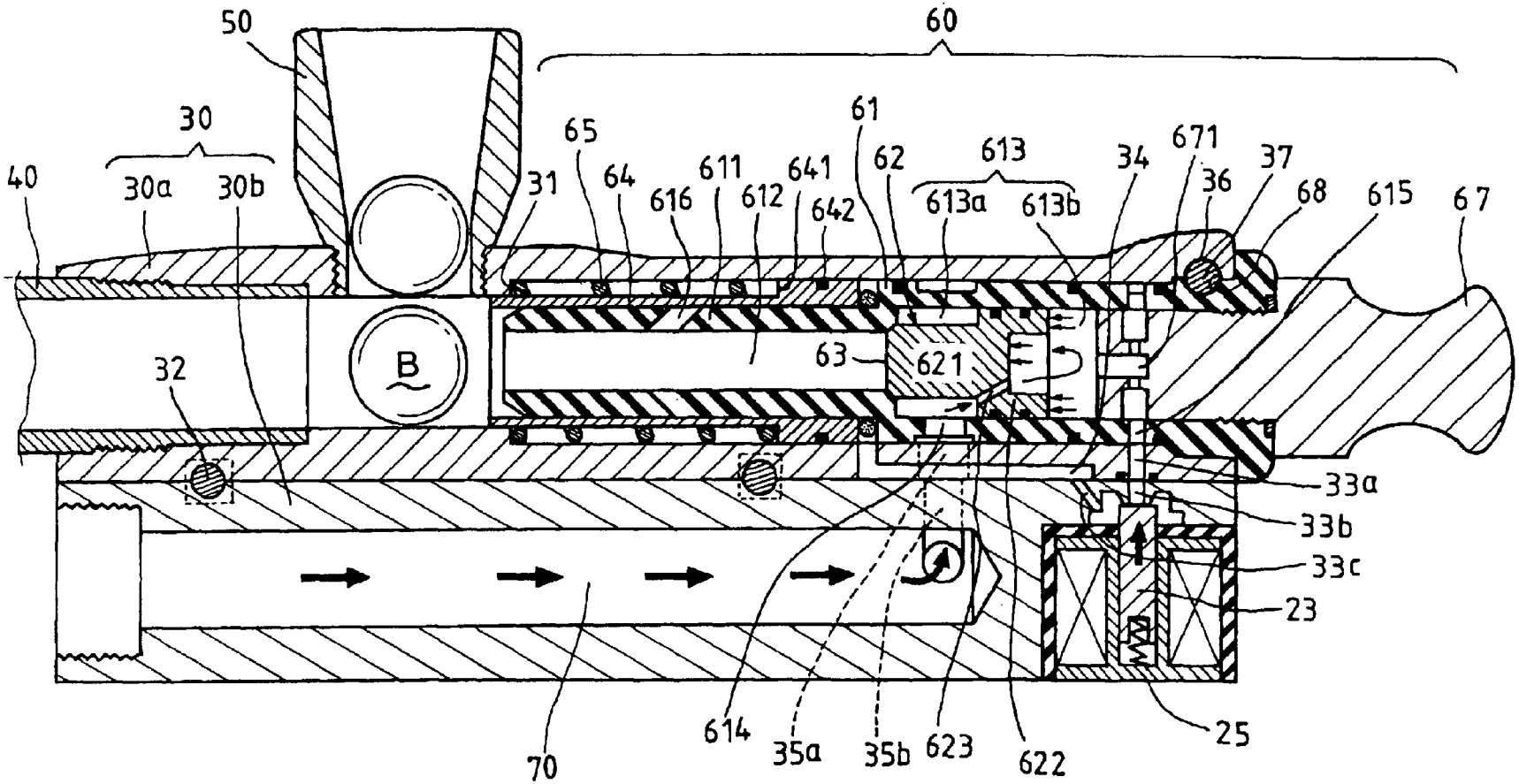
FIG. 6 is a sectional view of a pneumatic delivery mechanism in initial state.

The pneumatic delivery mechanism 60 is installed within the barrel assembly 30 und used to push and discharge the paintballs. The main configuration of the invention lies in the principle and technique of the pneumatic delivery mechanism 60. Referring to FIG. 6, the pneumatic delivery mechanism 60 includes a flow-guiding body 61, a flow-guiding movable body 62 and a delivery tube 64.

The flow-guiding body 61 is positioned within the upper barrel 30*a*. The front part of the flow-guiding body 61 is constructed as a tube 611 having a through hole 616 inclinedly extended at the top wall. Besides, the flow-guiding body 61 has an axially extending hole with a smaller diameter at the front part and a larger diameter at the rear part while a tail stopper 67 is plugged into the rear part of the flow-guiding body 61, thereby forming a major air channel 612 at the front part and a flow-guiding chamber 613 at the rear part thereof. The flow-guiding chamber 613 includes an input port 614 which is in connection with upper and lower inlets 35*a*, 35*b* of the upper and lower barrels 30*a*, 30*b*. The tail stopper 67 has an outlet port 671 extending from axial direction to radial direction at the inner end thereof. The outlet port 671 communicates with an outlet channel 615 in the larger part of the flow-guiding body 61 while the outlet channel 615 is further connected to an upper and a lower outlet 33*a*, 33*b* of the upper and the lower barrels 30*a*, 30*b*. A stopper 23 is provided to control the opening and closing of the air flow channel. A connection channel 33*c* is disposed beside the lower outlet 33*b* and connected to a minor air channel 34 at the outer side of the bottom of the tube 611. The movement of the stopper 23 is controlled by the trigger assembly 20.

Figure 12:
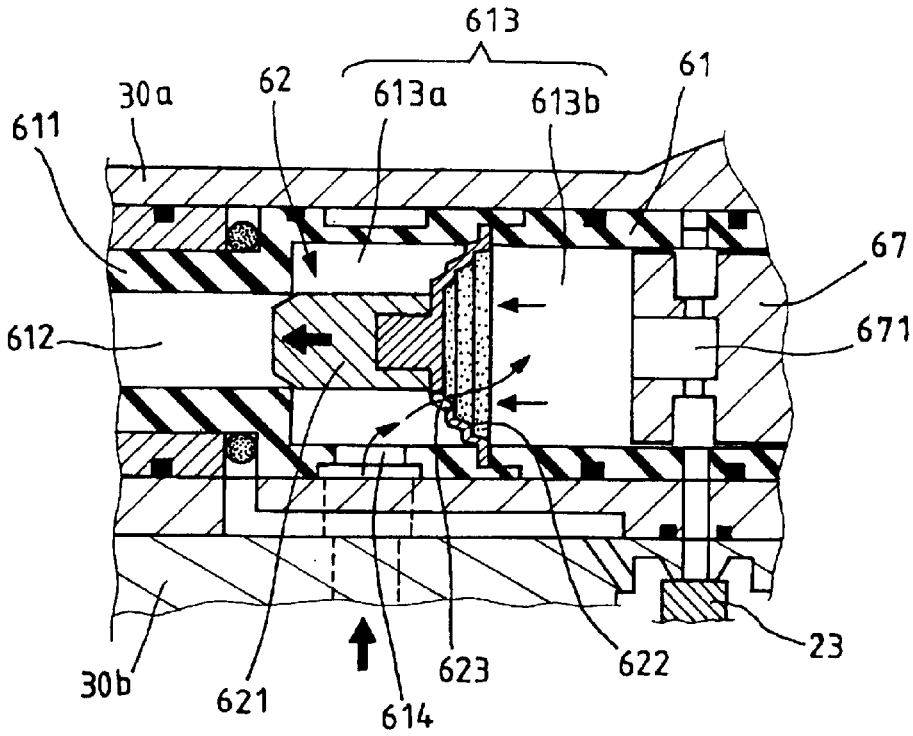
FIG. 12 is a sectional view of another applicable embodiment of the pneumatic delivery mechanism.
Figure 13:
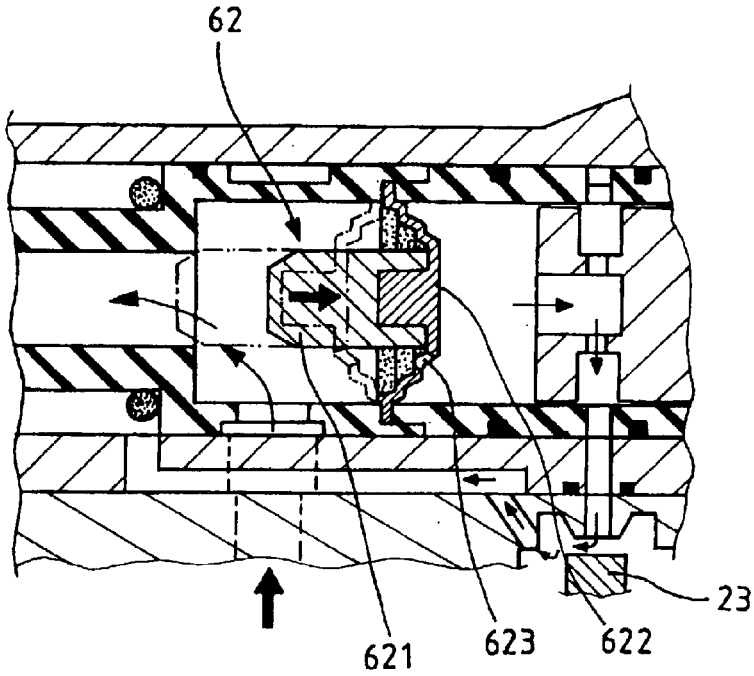
FIG. 13 is a sectional view of a further applicable embodiment of the pneumatic delivery mechanism.

The flow-guiding piston 62 is disposed within the flow-guiding chamber 613 with a slimmer front part and a wider rear part. An air piston 621 at the front end of the flow-guiding piston 62 is forced against the major air channel 612 while a separating body 622 at the rear end of the flow-guiding piston 62 is inserted into the internal wall of the flow-guiding chamber 613 such that the flow-guiding chamber 613 is divided by the separating body 622 into a front and a rear air pressure chamber 613*a*, 613*b* with different pressure area. A small through hole 623 is interposed between the front and the rear air pressure chambers 613*a*, 613*b*. The separating body 622 can be constructed as a valve unit, as shown in FIGS. 6 through 11. Instead of the valve unit, the separating body 622 can be constructed as a membrane unit, as shown in FIGS. 12 and 13. Both types of the separating body 622 are movable within the flow-guiding chamber 613 for changing the air pressure.

The delivery tube 64 is placed around the tube 611 at the front end of the flow-guiding body 61. A return spring 65 is disposed around the front part of the delivery tube 64.

Accordingly, the stopper 23 is used to control the opening or closing of air flow channel, thereby leading to a pressure difference between the front and rear air pressure chambers 613*a*, 613*b* of the flow-guiding piston 62. As a result, the delivery tube 64 is shifted forward by means that a small amount of air flow is fed into the minor air channel 34 so as to push a paintball B a little forward. Thereafter, the paintball B is discharged by means of thrust of air flow into the major air channel 612.

The delivery tube 64 has a flange 641 at the rear end thereof against which one end of the return spring 65 is fixed. Moreover, the upper barrel 30*a* is provided with a corresponding flange 31 against which the other end of the return spring 65 is pressed. An O-ring 642 is disposed around the outer circumference of the rear end of the delivery tube 64.

Again, referring to FIGS. 5 and 5(*b*), the pneumatic delivery mechanism 60 of the invention can be axially inserted into the upper barrel 30*a*, so that the pneumatic delivery mechanism 60 is easily taken out for maintenance. Moreover, the flow-guiding body 61 includes an arched groove 68 at one end adjacent to the tail of the paintgun while the upper barrel 30*a* has a transverse through hole 36 at a corresponding position. When a positioning pin 37 is inserted into a transverse through hole 36, the positioning pin 37 engages into the arched groove 68 so that the pneumatic delivery mechanism 60 is fixed in place, as shown in FIG. 6. In addition, the barrel assembly 30 of the invention can be constructed in a piece while it is scooped out with the above-mentioned inlet and outlet channels. Anyway, the two-part barrel assembly 30, as shown in FIGS. 5(*a*) and 5(*b*) is more convenient for fabrication.

The above-mentioned are the primary structure and features of the pneumatic delivery mechanism 60. The operational principles thereof, as shown in FIGS. 6 through 8, are described as follows:

First of all, referring to FIG. 6, the initial state of the pneumatic delivery mechanism 60 is shown. Here, the stopper 23 closes the passage of the minor air channel 34 while the air pressure source 70 of high pressure gas enters through the upper and lower inlets 35*a*, 35*b* and the input port 614 into the flow-guiding chamber 613. Then, it passes through the small through hole 623 into the rear air pressure chamber 613*b*. The pressure area of the rear air pressure chamber 613*b* upon the valve body 622 is much greater than the closing area 63 of the air valve 621. Therefore, the flow-guiding piston 62 is shifted forward. Meanwhile, the air valve 621, is pressed against the passage of the major air channel 612, thereby blocking the air pressure released from the major air channel 612.

Figure 7:
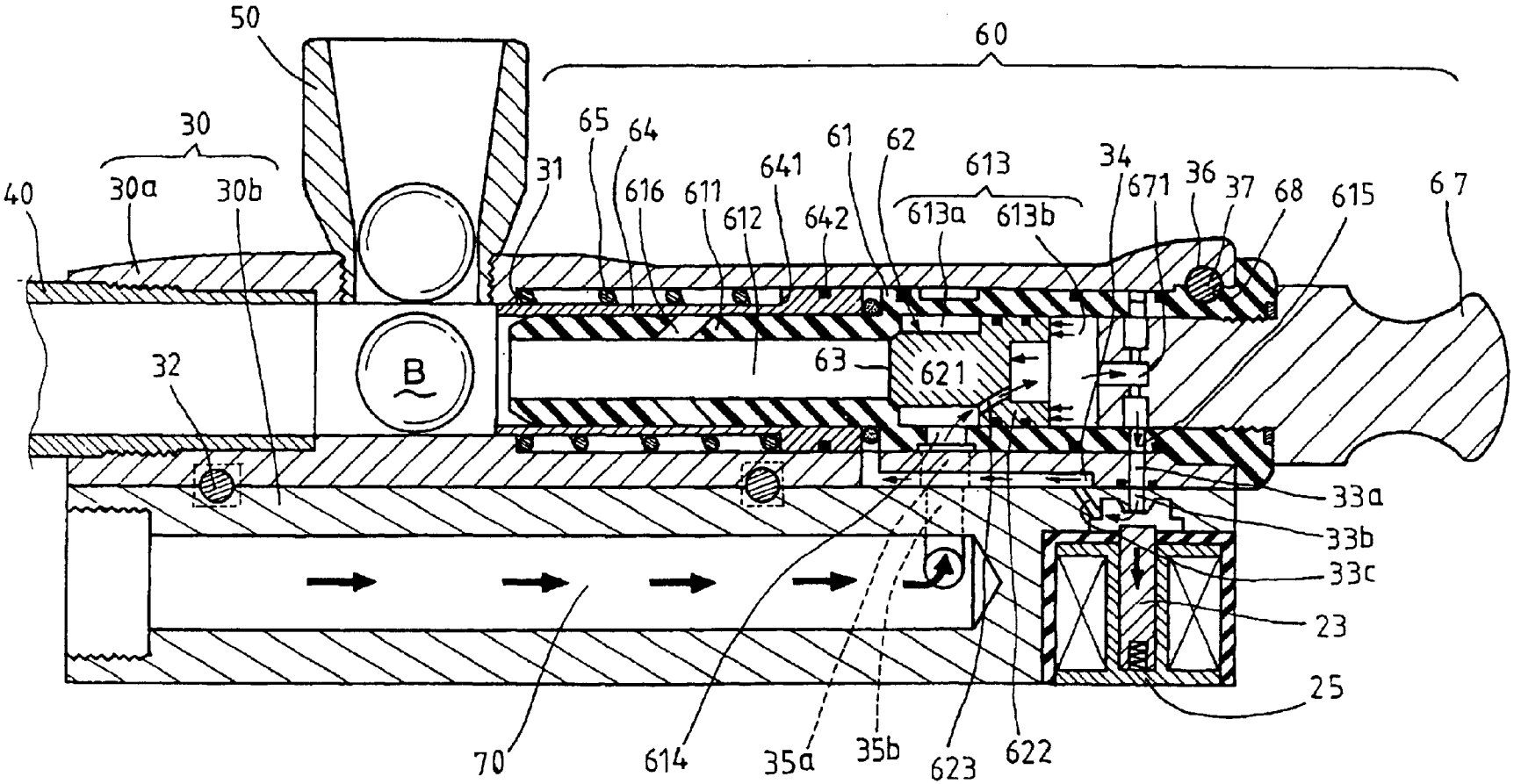
FIG. 7 is a sectional view of the pneumatic delivery mechanism in an opened state by a stopper.
Figure 8:
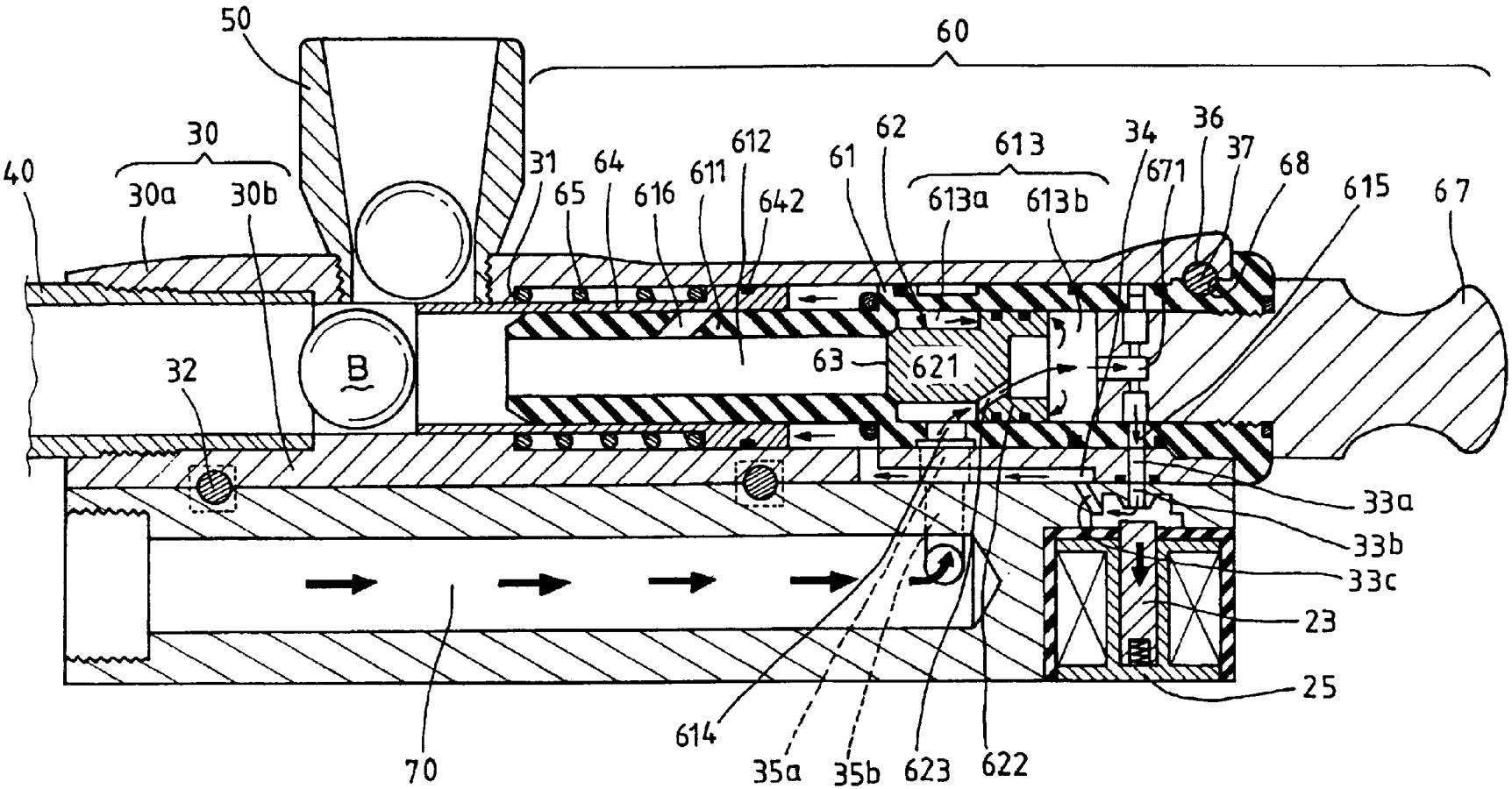
FIG. 8 is a sectional view of the pneumatic mechanism showing that the paintball is shifted forward by limited airflow through minor air channel.
Figure 9:
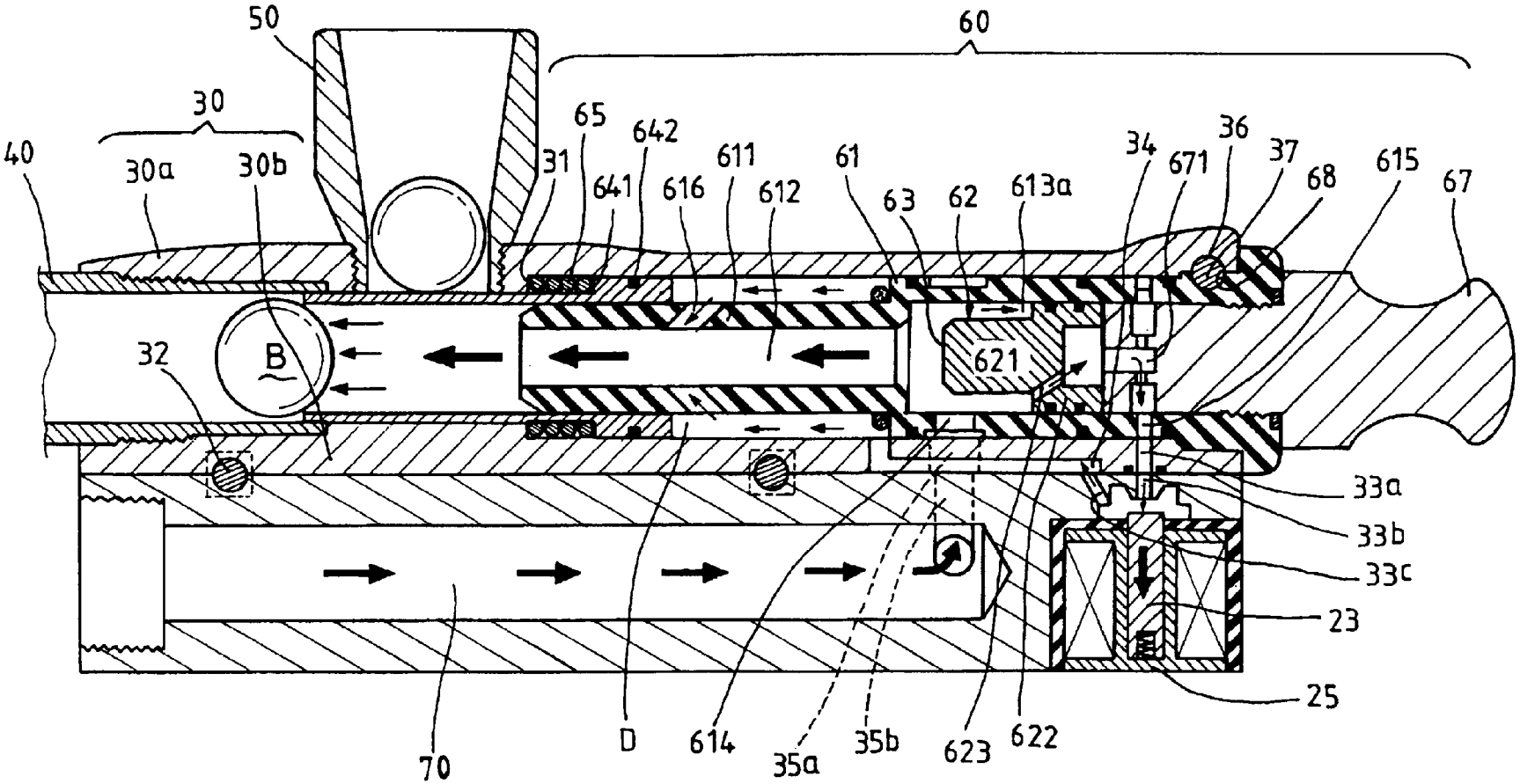
FIG. 9 is a sectional view of the pneumatic mechanism showing that the paintball is discharged by a great amount of airflow through major air channel.

Then, referring to FIG. 7, the stopper 23 is controlled by the trigger assembly 20 to be moved downward such that the passage of the minor air channel 34 is opened. Here, the high pressure gas within the rear air pressure chamber 613*b* may enter through the outlet port 671, the output port 615, the upper and lower outlets 33*a*, 33*b*, the connection channel 33*c* and the minor air channel 34 into the rear side (the area marked with A) of the delivery tube 64 of the upper barrel 30*a*. As a result, this air pressure can push the delivery tube 64 forward, thereby bringing the paintball B forward which falls from the paintball-feeding tube 50. The volumen A of the pushing surface of the delivery tube 64 is smaller than the rear air pressure chamber 613*b*. Meanwhile, the air flow is continuously fed with slight amount through the small through hole 623 into the rear air pressure chamber 613*b*. Since the pushing force on the valve body 622 is still greater than the force on the closing area 63 of the air valve 621, the flow-guiding piston 62 won't be moved. Furthermore, referring to FIG. 8, when the delivery tube 64 is shifted forward to gradually arrive in the minor air channel 34 of the tube 611, the air flow, as shown in FIG. 9, is led through the through hole 616 into the tube 611. Since the small through hole 623 has too small diameter to supply sufficient air required by the rear air pressure chamber 613*b*, the gas pressure of flow field is changed. Here, the pressure within the rear air pressure chamber 613*b* is lowered. Meanwhile, the pressure within the front air pressure chamber 613*a* is changed to be greater than that of the rear air pressure chamber 613*b* so that the flow-guiding piston 62, as shown in FIG. 9, is shifted backward such that the air valve 621, as shown in FIG. 9, moves backward and departs from the input port of the major air channel 612. Therefore, a great amount of gas thrusts past major air channel 612 into the delivery tube 64, thereby discharging the paintball B.

Figure 10:
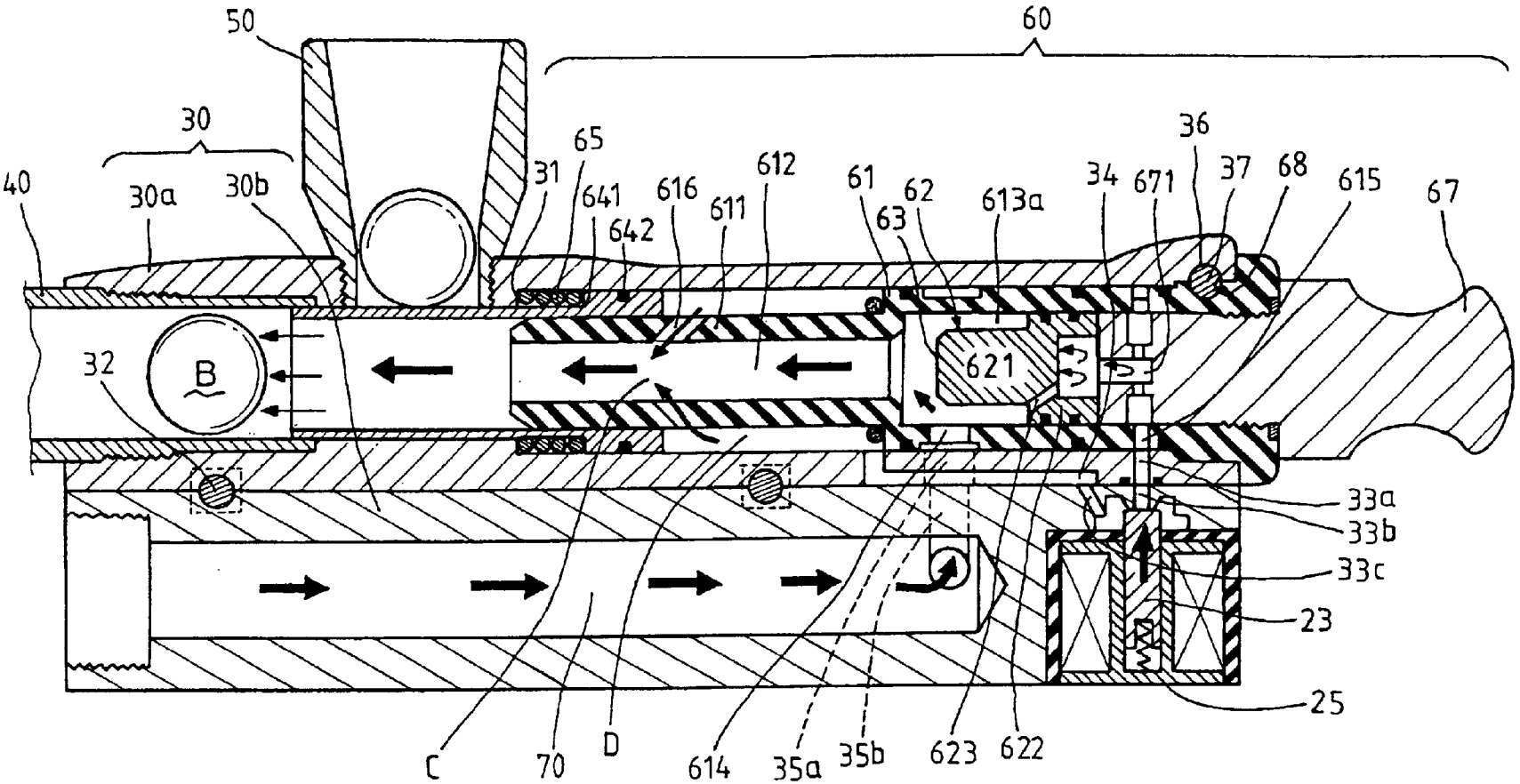
FIG. 10 is a sectional view of the pneumatic mechanism in a closed state by a stopper.

Thereafter, referring to FIG. 10, the stopper 23 shifts upward to renewedly close the passage of air flow of the minor air channel 34. Here, the flow-field pressure is changed and the rear air pressure chamber 613*b* regains the pressure. In addition, when air flow thrusts into the major air channel 612, the top end C opposite to the through hole 616 creates a draw-off effect of the fluid mechanics. Therefore, the gas in the area D of the upper barrel 30*a* is drawn off and shown in half-vacuum state to reduce the resistance of the return spring 65 back to the delivery tube 64. Thus, referring to FIG. 11, the delivery tube 64 inwardly returns and the pressure area of the rear air pressure chamber 613*b* upon the valve body 622 is much greater than the closing area 63 of the air valve 621 in the front air pressure chamber 613*a*. Accordingly, the initial state in FIG. 6 is regained.

Figure 11:
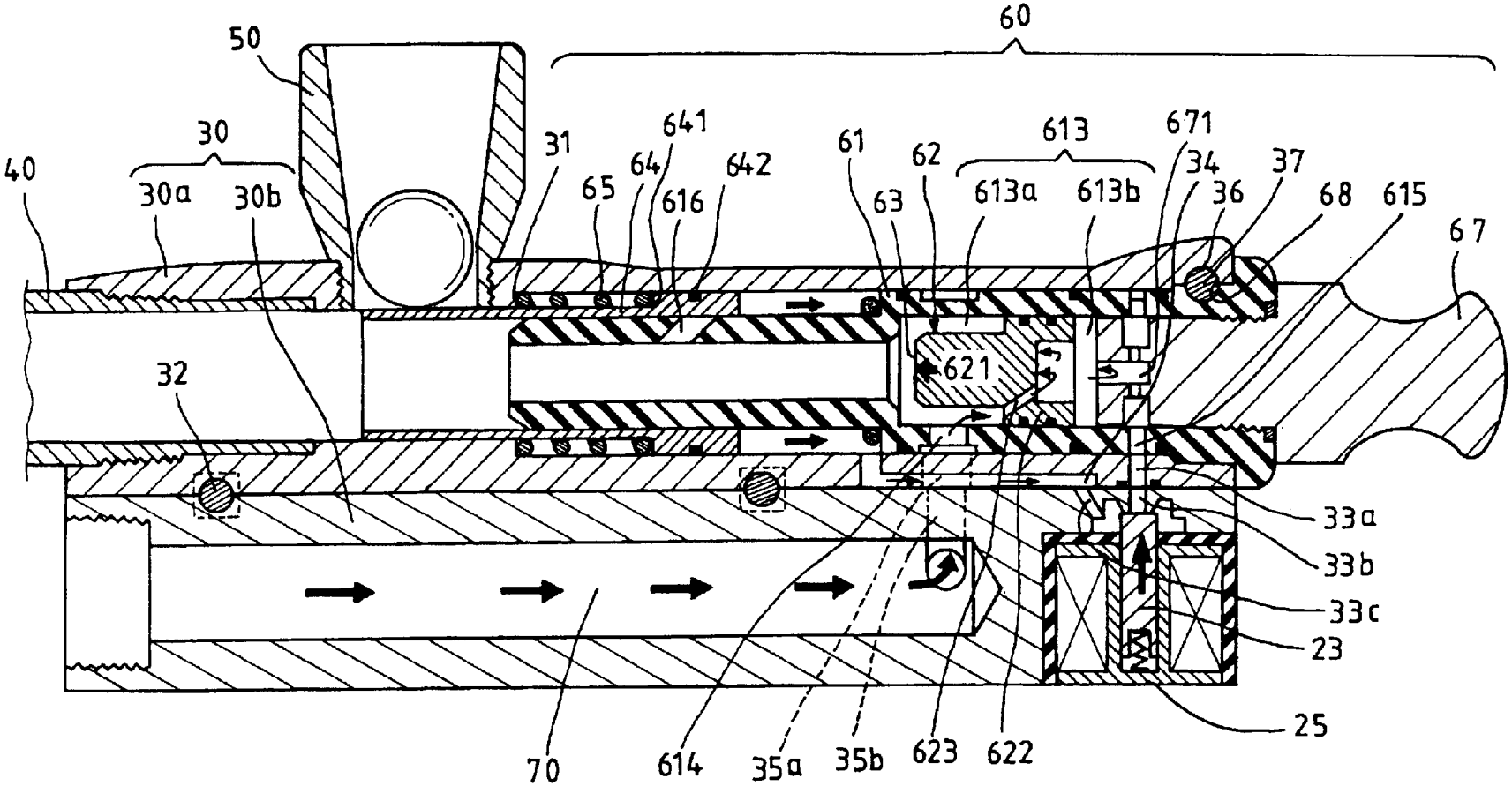
FIG. 11 is a sectional view of the pneumatic mechanism showing the movement of the flow-guiding valve.
Figure 11A:
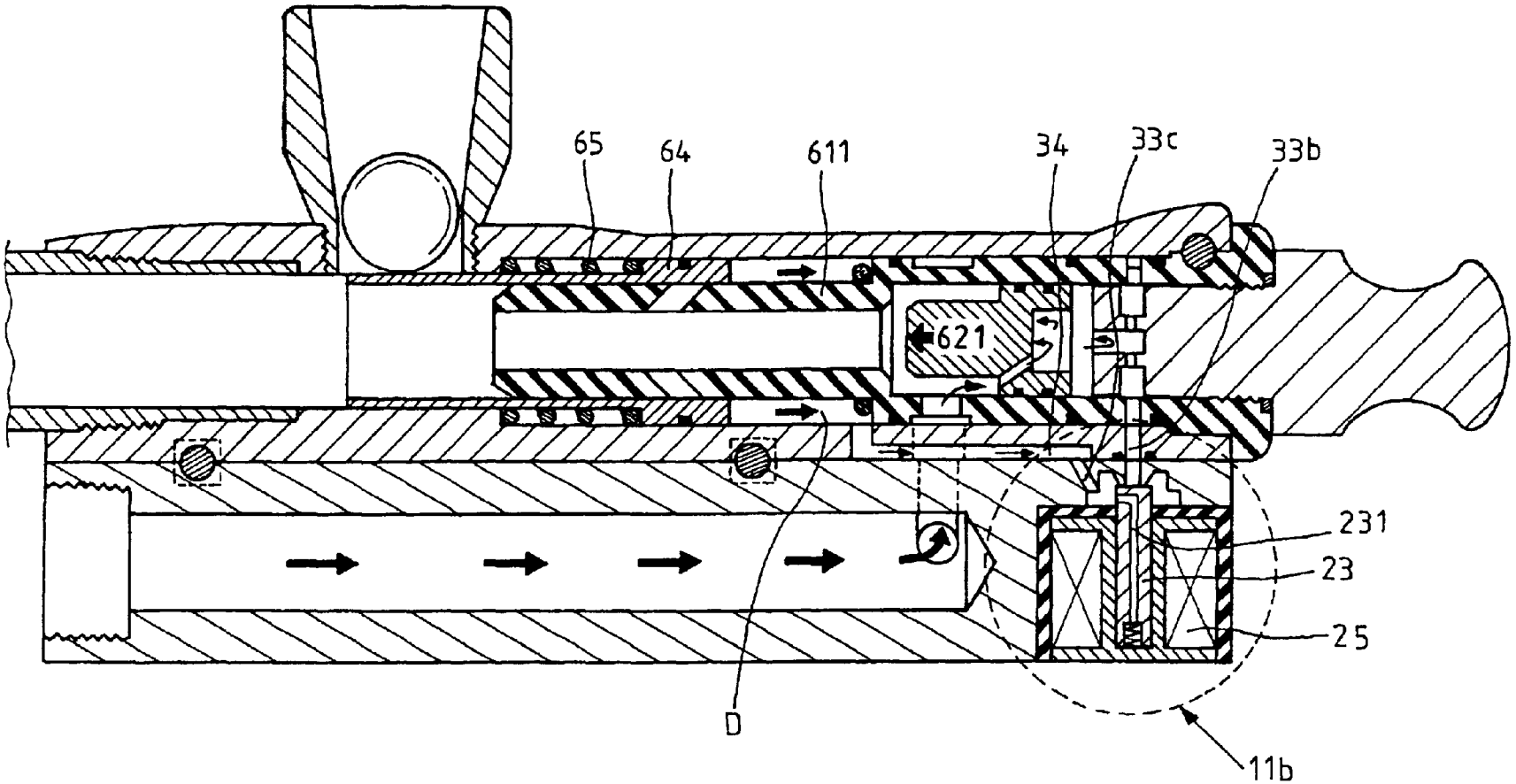
Figure 11B:
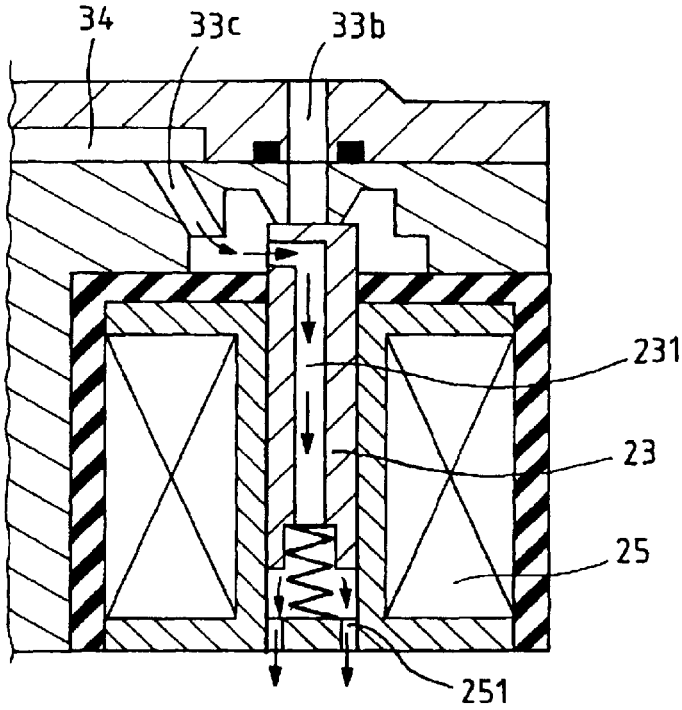
Figure 11C:
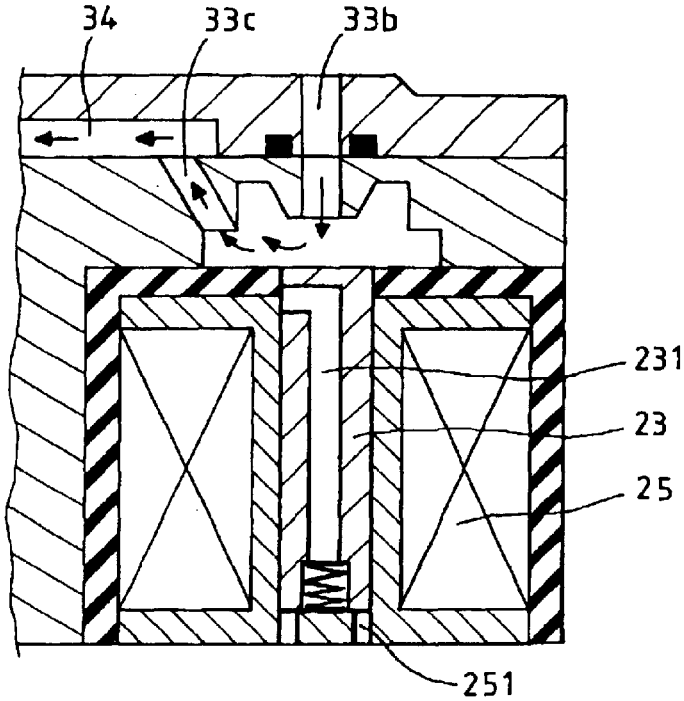

In testing the invention, it's found that little gas remains in the D-area and the minor air channel 34 when the delivery tube 64 is returned inwardly, thereby producing a slight resistance (see FIG. 11(*a*)). As shown in FIG. 11(*b*), the stopper 23 includes an air-returning hole 231 via which the remaining gas can be exhausted from the connection channel 33*c* to an exhaust hole 251 at the bottom of the stopper 23. Accordingly, the restoration thereof is more rapid and smooth. Moreover, when the stopper 23 is moved downward to open the lower outlet 33*b*, the exhaust hole 251 is closed by the bottom surface of the stopper 23 (see FIG. 11(*c*)). Therefore, it's assured that the gas injected from the lower outlet 33*b* won't be exhaused by the air-returning hole 231, but led through the connection channel 33*c* into the minor air channel 34.

Again, referring to FIG. 5 together with the other figures, the stopper 23 of the invention can be configured as a central shaft or the like of a control element 25 of an electromagnetic valve or an electromagnet. In this embodiment, the electromagnetic valve is used as control element 25. Besides, the trigger assembly 20 includes a trigger 21, firing circuit 22 and batteries 24. In pulling the trigger 21, the switch of the firing circuit 22 is actuated, thereby shifting the stopper 23 of the control element 25 to achieve the control effect of the passage. However, the trigger assembly 20 and the electromagnetic valve are conventional elements so that no further descriptions are given hereinafter.

According to the above-mentioned, the pneumatic delivery mechanism 60 of the invention makes use of the change of the flow-field pressure. A minor air flow is used to push the delivery tube 64 first so as to bring the paintball B forward. Then, the discharge is performed by the thrusting air flow. The two-stage air delivery system achieves the following effects:

1. Unlike the conventional paintgun, the invention doesn't have the firing hammer to open the air valve so that the wearing of the mechanic engagement can be avoided. Moreover, the danger of the reciprocating shift of the push rod can be eliminated. As a result, the safety in whole can be enhanced.
2. The invention has simple configuration and easy assembly so that the malfunction rate is reduced.
3. The most important lies in that the airflow is fully injected into the major air channel 612 when the major air channel 612 uses airflow. Thus, the great amount of airflow can be concentrated without dispersion so that the paintball can be smoothly and axially discharged in acceleration way. As shown in FIG. 8, when the paintball is discharged through the major air channel 612, the feeding opening at the bottom of the paintball-feeding tube 50 is closed by the delivery tube 64 so that the air flow won't be dispersed to create air turbulence. Consequently, the invention can smoothly discharge the paintball B to preset distance only under the pressure of 20 kg/cm$^2$. Therefore, the pressure of the air pressure source 70 can be reduced and the same pressure source can be used for a longer time. Accordingly, the safety can not only be elevated, but also the cost can be reduced.
4. The pneumatic delivery mechanism 60 of the invention is axially detachable from the barrel assembly 30. In pulling the positioning pin 37 out of the transverse through hole 36, the pneumatic delivery mechanism 60 can be easily taken out from the barrel assembly 30 for maintenance.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A paintgun with pneumatic feeding and discharging process comprising:

a) a trigger assembly used to actuate the firing element of paintballs;

b) a barrel assembly fitted above the trigger assembly, a bore being provided at the front end thereof, a paintball-feeding tube being disposed above the bore; and c) a pneumatic delivery mechanism installed within the barrel assembly, including;

i) a flow-guiding body positioned within an upper barrel, the front part of the flow-guiding body being constructed as a tube having a through hole inclinedly extended at the top wall, the flow-guiding body having an axially extending hole with a smaller diameter at the front part and a larger diameter at the rear part while a tail stopper is plugged into the rear part of the flow-guiding body, thereby forming a major air channel at the front part and a flow-guiding chamber at the rear part thereof, the flow-guiding chamber having an input port which is in connection with upper and lower inlets of the upper barrel and a lower barrel, the tail stopper having an outlet port extending from axial direction to radial direction at the inner end thereof, the outlet port communicating with an outlet channel in the larger part of the flow-guiding body while the outlet channel is further connected to an upper and a lower outlet of the upper and the lower barrels, a stopper being provided to control the opening and closing of the air flow channel, a connection channel being disposed beside the lower outlet and connected to a minor air channel at the outer side of the bottom of the tube, the movement of the stopper being controlled by the trigger assembly;

ii) a flow-guiding piston disposed within the flow-guiding chamber with a slimmer front part and a wider rear part, an air piston at the front end of the flow-guiding piston being forced against the major air channel while a separating body at the rear end of the flow-guiding piston is inserted into the internal wall of the flow-guiding chamber such that the flow-guiding chamber is divided by the separating body into a front and a rear air pressure chamber with different pressure area, a small through hole being interposed between the front and the rear air pressure chambers; and iii) a delivery tube placed around the tube at the front end of the flow-guiding body, a return spring being disposed around the front part of the delivery tube;

whereby the stopper is used to control the opening or closing of air flow channel, thereby leading to a pressure difference between the front and rear air pressure chambers of the flow-guiding piston, and the delivery tube is shifted forward by means that a small amount of air flow is fed into the minor air channel so as to push a paintball a little forward; thereafter, the paintball is discharged by means of thrust of air flow into the major air channel.

2. The paintgun with pneumatic feeding and discharging process as recited in claim 1 wherein the barrel assembly is composed of the upper and lower barrel, both of which are assembled by fastening elements.

3. The paintgun with pneumatic feeding and discharging process as recited in claim 2 wherein the upper and lower barrels have an upper and a lower inlet and an upper and a lower outlet, respectively.

4. The paintgun with pneumatic feeding and discharging process as recited in claim 1 wherein the barrel assembly is formed in a piece.

5. The paintgun with pneumatic feeding and discharging process as recited in claim 1 wherein the delivery tube has a flange at the rear end thereof against which one end of the return spring is fixed, and wherein the barrel assembly is provided with a corresponding flange against which the other end of the return spring is pressed, and wherein an O-ring is disposed around the outer circumference of the rear end of the delivery tube.

6. The paintgun with pneumatic feeding and discharging process as recited in claim 1 wherein the separating body is a piston.

7. The paintgun with pneumatic feeding and discharging process as recited in claim 1 wherein the separating body is a membrane.

8. The paintgun with pneumatic feeding and discharging process as recited in claim 1 wherein the trigger assembly includes a trigger, firing circuit, batteries and control elements.

9. The paintgun with pneumatic feeding and discharging process as recited in claim 8 wherein the control element includes a stopper.

10. The paintgun with pneumatic feeding and discharging process as recited in claim 8 wherein the control element includes a stopper.

11. The paintgun with pneumatic feeding and discharging process as recited in claim 8 wherein the air pressure source is supplied by an air pressure tank.

* * * * *